United States Patent [19]

Lang

[11] 4,373,843

[45] Feb. 15, 1983

[54] PADDING PRESS

[75] Inventor: Franklin D. Lang, Mission Viejo, Calif.

[73] Assignee: Nitney Corporation, Laguna Hills, Calif.

[21] Appl. No.: 259,972

[22] Filed: May 4, 1981

[51] Int. Cl.[3] ..... B42C 13/04; B30B 1/30

[52] U.S. Cl. ..... 412/10; 100/226

[58] Field of Search ..... 100/219, 278, 226; 412/10, 11-17; 269/88, 216, 234, 303

[56] References Cited

U.S. PATENT DOCUMENTS

| | | | |
|---|---|---|---|
| 1,354,061 | 9/1920 | Palmer | 412/10 |
| 2,494,424 | 1/1950 | Adelsohn et al. | 412/10 X |
| 2,499,744 | 3/1950 | Goines et al. | 412/10 X |
| 2,654,932 | 10/1953 | Goudie | 412/10 X |
| 3,986,447 | 10/1976 | Zimmer | 412/10 X |
| 4,146,942 | 4/1979 | Westra et al. | 412/10 |

*Primary Examiner*—Paul A. Bell
*Assistant Examiner*—John S. Brown
*Attorney, Agent, or Firm*—Klein & Szekeres

[57] ABSTRACT

An improved padding press adapted for convenient and relatively rapid padding of continuously variable sizes of paper, is disclosed. The padding press includes a base which incorporates a blower assembly for forced movement of heated air. A support board assembly, including a main support board, is slideably positioned on a top surface of the base and is adapted to occupy at least one predetermined fixed position thereon. An adjusting board is removably attachable to the base into a position wherein the adjusting board is substantially perpendicular to the main support board. The adjusting board has a pair of adjustably mounted guide rails adapted for receiving continuously variable sizes of paper. A clamping board is attachable to the support board assembly through a pair of cords and a clamping bracket assembly. Each cord is attached to the support board assembly through a rotatable and lockable spindle so that the tension of the cord is adjustable. The clamping bracket assembly is adapted to require a small physical force on the part of the operator to be locked into a clamping position wherein the clamping board applies a clamping pressure on a stack of paper positioned between the clamping board and the main support board. The support board assembly is adapted to be slid out of its predetermined fixed position to expose a glued edge of the stack of paper to heated air blown by the blower assembly.

20 Claims, 5 Drawing Figures

FIG. 5
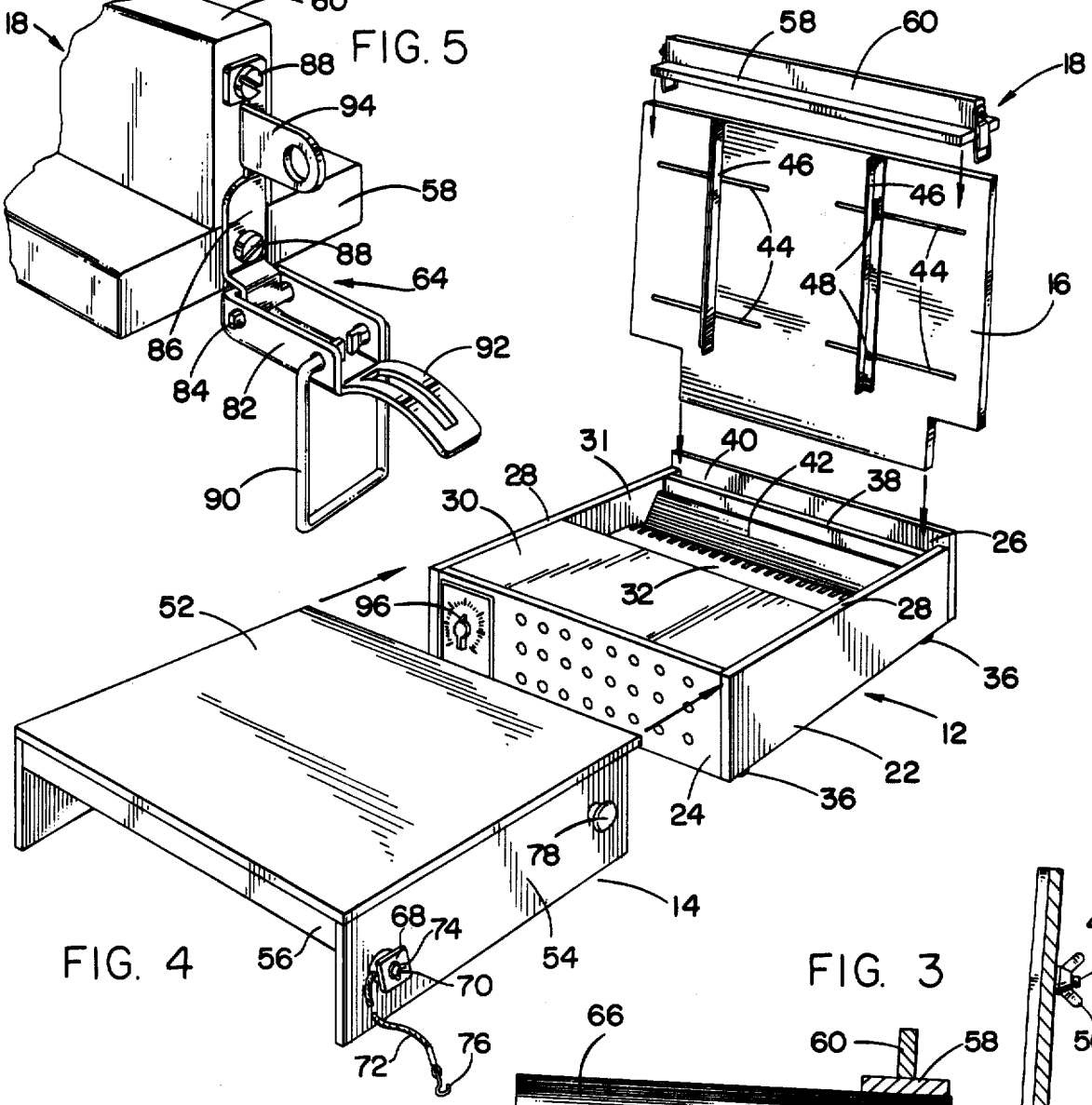
FIG. 4
FIG. 3
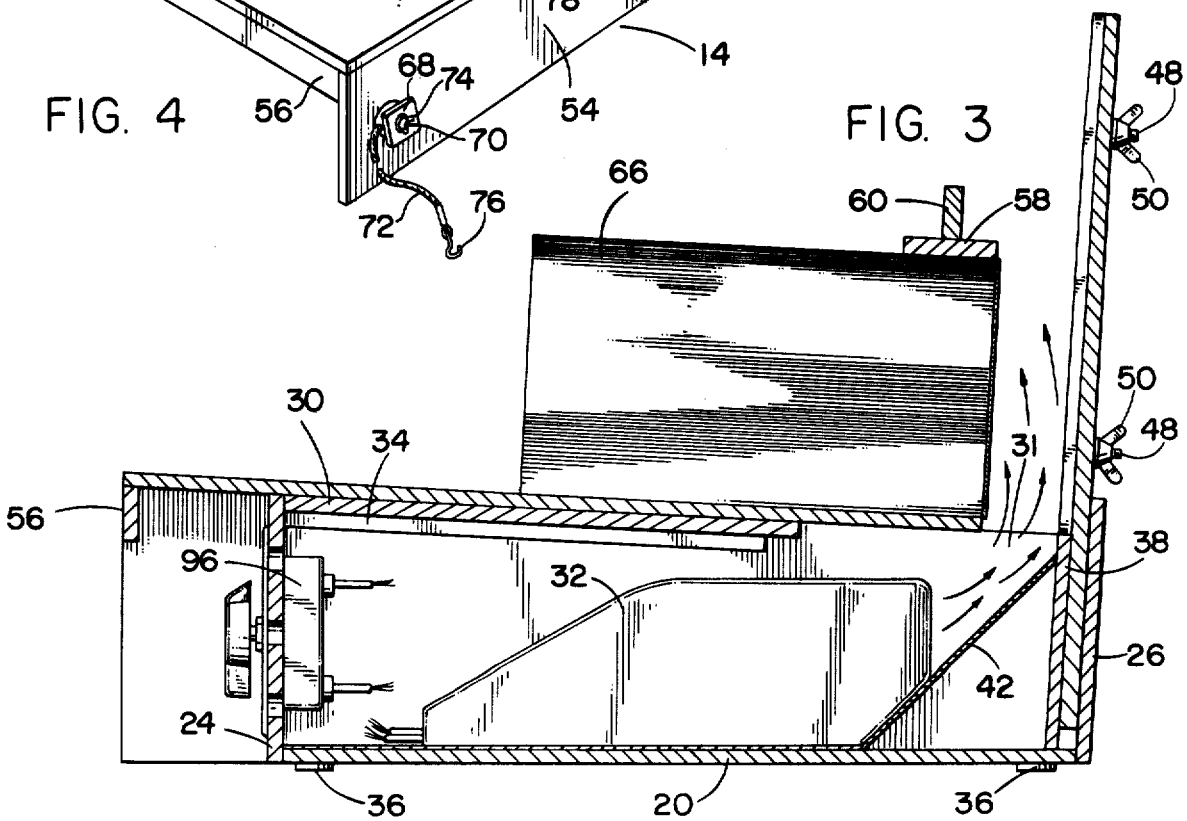

PADDING PRESS

BACKGROUND OF THE INVENTION

1. Field of the Invention

The present invention is directed to a padding press. More particularly, the present invention directed to an improved padding press which is adapted to receive several sizes of stacks of paper to be padded, for applying a clamping force on the stack of paper by exertion of a minimal effort by an operator and for drying a glue or like adhesive substance which is utilized for binding together the stack of paper.

2. Brief Description of the Prior Art

Padding presses have been known in the art for a long time. During a padding operation, a stack of paper, usually consisting of identically-sized rectangular sheets, is placed upon a substantially flat surface so that the edges of the paper in the stack are aligned with one another. Usually, cardboards or like relatively stiff paper members are interspaced with the sheets of paper in the stack in order to provide a relatively rigid base for the individual pads. A clamping force is then brought to bear down on the stack and a glue or adhesive is applied to an exposed edge of the stack. After the glue or adhesive has hardened, the clamping force is released and the stack is separated into individual pads.

The padding presses or padding machines of the prior art are generally designed to enable an operator to perform the above-noted steps. For this purpose, the padding presses of the prior art generally include a support surface or board upon which the stack of paper is placed. An adjusting surface or board is usually provided in a substantially perpendicular position relative to the support board, and a manually operable and lockable clamping press is usually attached to the support board. The purpose of the adjusting board is to permit alignment of the edges of the sheets of paper in the stack adjacent to the adjusting board. After the clamping force is applied to the stack of paper, the adjusting board is usually removed so as to expose the aligned edges of the stack for the gluing step. In many of the prior art padding presses, the assembled support and adjusting boards are tiltable into a position wherein the stack of paper is pulled toward the adjusting board by the force of gravity. For the gluing step, the support board is, however, usually tilted back into a substantially horizontal position.

For a more detailed description regarding the state of the padding press manufacturing art, reference is made to U.S. Pat. Nos.: 4,146,942; 3,986,447; 3,889,590; 2,708,400; 2,641,781; 2,526,987; 2,494,424; and 1,354,061.

In some padding presses of the prior art, such as the ones described in U.S. Pat. Nos. 3,986,447 and 2,641,781 a separate clamping rack is provided to be used in association with a support rack. In these devices, the clamping rack holding the clamped-together stack of paper is removed from the support rack in order to expose a desired edge of the stack for a gluing operation.

Even though a relatively large variety of padding presses have been provided in the prior art, the prior art devices still need substantial improvement in several aspects. More specifically, a disadvantage of many of the prior art devices is that an operator is required to exert a relatively large physical force to provide sufficient clamping pressure to the stack of paper to be padded.

Another disadvantage of most of the prior art devices is that the devices are not adapted for receiving continuously varying sizes of papers for alignment for the padding operation. In other words, most prior art devices are adapted to receive either only one size of paper or only several predetermined sizes of paper.

Still another disadvantage of the prior art devices is that the glue or adhesive applied to the edges of the papers is dried by a mere passive air drying process. Stated differently, in the prior art, an operator must wait until the glue or adhesive dries and binds; the drying and binding process is not aided by application of heat or forced circulation of air. It will be readily appreciated by those skilled in the art, that the delay occasioned by waiting for an appreciable amount of time for the glue or adhesive to dry while the stack of paper is clamped in the padding press, is inconvenient. It also increases the cost of the final padded paper products.

The present invention is directed to an improved padding press which overcomes or minimizes the above-noted disadvantages of the prior art.

SUMMARY OF THE INVENTION

It is an object of the present invention to provide a padding press wherein an operator is required to exert only a minimal amount of force in order to clamp a stack of papers in preparation for a gluing step.

It is another object of the present invention to provide a padding press which is adapted to receive and properly align for gluing, continuously varying sizes of paper.

It is still another object of the present invention to provide a padding press wherein drying and bonding of the glue or adhesive is accelerated by application of forcibly-circulated heated air.

These and other objects and advantages are attained by an improved clamping press which has a base member and a support board assembly including a main support board. The support board assembly is slideable on a top surface of the base member to occupy at least one predetermined, fixed position thereon. An adjusting board is removably attachable to the base member into a position wherein the adjusting board is substantially perpendicular to the main support board. The adjusting board has a pair of substantially parallel disposed guide rails, the positioning of which may be continuously adjusted relative to the adjusting board. The guide rails are adapted to align a stack of paper on the support board for the ensuing clamping and gluing operation.

A clamping board is attachable to the support assembly through a pair of cords and a clamping bracket assembly. Each cord is attached to the support board assembly through a rotatable spindle so that the tension of the cord is adjustable. The clamping bracket assembly is adapted to require a small physical force on the part of an operator to be locked into a clamping position wherein the clamping board applies a clamping pressure on the stack of paper positioned between the clamping board and the main support.

An air blower is incorporated in the base member to blow heated air upon a glued edge of the stack of paper to accelerate the bonding of the glue.

The features of the present invention can be best understood together with further objects and advantages by reference to the following description, taken in connection with the accompanying drawings wherein like reference numerals indicate like parts.

BRIEF DESCRIPTION OF THE DRAWINGS

FIG. 3 is a cross sectional view of the improved padding press of the present invention, the view showing a stack of paper glued at one of its edges and being dried by forced, heated air, the cross-section being taken at lines 3,3 of FIG. 1;

FIG. 4 is an exploded perspective view of the improved padding press of the present invention, and FIG. 5 is a perspective view of the clamping bracket assembly of the padding press of the present invention.

DESCRIPTION OF THE PREFERRED EMBODIMENT

The following specification taken in conjunction with the drawings sets forth the preferred embodiment of the present invention in such a manner that any person skilled in the padding press manufacturing and related arts can use the invention. The embodiment of the invention disclosed herein is the best mode contemplated by the inventor for carrying out his invention in a commercial environment, although it should be understood that various modifications can be accomplished within the parameters of the present invention.

Figure 1:
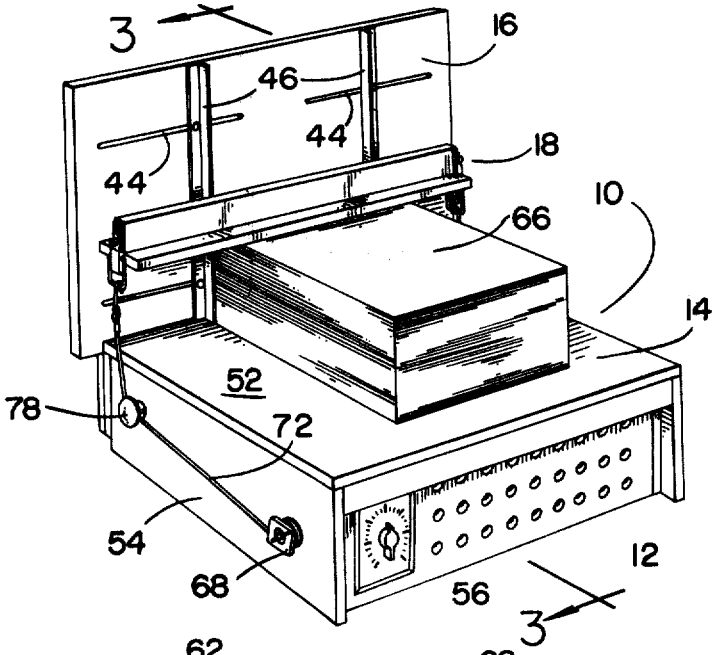
FIG. 1 is a perspective view of the improved padding press of the present invention, the view showing a stack of paper clamped in the padding press.

Referring now to the drawing Figures, and more particularly to the perspective views of FIGS. 1 and 4, a preferred embodiment of the improved padding press 10 of the present invention is disclosed. The padding press 10 includes a substantially box shaped base member or base 12, a support board assembly 14, an adjusting board 16 and a clamping board assembly 18.

It should be noted at the outset that the above-noted component parts of the improved padding press 10 of the present invention are preferably manufactured from wooden boards, plywood or like material. For this reason reference is often made in this specification to several component parts being boards. It should be understood, however, that other materials may also be utilized for the construction of the improved padding press 10 of the present invention. Therefore, the present description referring to wooden or plywood boards should be construed as being exemplary rather than limiting in nature.

Referring again to the drawing Figures and particularly to the perspective views of FIGS. 1 and 4 and the cross-sectional view of FIG. 3, a detailed construction of the box shaped base 12 is disclosed. The base 12 includes a bottom board 20, two substantially parallel disposed side boards 22, a front board 24 and a back board 26. A top surface 28 of each of the side boards 22 is slightly slanted or sloped downwardly from the front board 24 toward the back board 26.

The base 12 also includes a cover board 30 which, however, does not cover the entire base 12. Instead, the cover board 30 only covers a front portion of the base 12, with a gap 31 being provided in the back portion. The gap 31 allows a blower assembly or blower 32 mounted in the base 12, to blow heated air in an upwardly direction, as is shown on FIG. 3. The cover board 30 is mounted flush with the top surface 28 of the side boards 22. In the herein described preferred embodiment, the cover board 30 is not permanently attached to the base 12, instead it is positioned on cleats 34, shown on FIG. 3.

The base 12 has four small rubber or plastic legs 36 mounted to a lower surface of the bottom board 20. A cross-board 38 is included in the base 12 in spaced parallel relationship with the back board 26. The cross-board 38 is best shown on FIGS. 3 and 4. A gap 40 located between the cross-board 38 and the back board 26 removably receives the adjusting board 16. A slanted or angularly disposed board 42 is mounted to the cross-board 38 and to the bottom board 20 within the base 12. The slanted board 42 is best shown on FIG. 3. Its purpose is to deflect air, blown by the blower 32, in an upwardly direction.

Referring still principally to FIGS. 1, 3 and 4, the adjusting board 16 is disclosed in detail. The adjusting board 16 is a substantially rectangularly shaped board having two cut-off corners to provide a tongue which removably fits in the gap 40 between the cross board 38 and the back board 26 of the base 12. As is apparent from an inspection of the drawing Figures, when the adjusting board 16 is inserted into the gap 40, the adjusting board 16 occupies a substantially upright position, and is substantially perpendicular to the top surfaces 28 of the sideboards 22 of the base 12.

Two pairs of substantially horizontally disposed slots 44 are provided in the adjusting board 16. A pair of parallel disposed guide rails 46, preferably manufactured from stamped sheet metal angle irons, are fastened to the adjusting board 16 through the slots 44. Bolts 48 and wing nuts 50 fastening the guide rails 46 to the adjusting board 16 are shown on FIG. 3. As is readily apparent from the above description, the guide rails 46 may be continuously adjusted by sliding the bolts 48 in their respective slots 44, whereby the padding press 10 may receive continuously varying sizes of paper. This is described in more detail below in conjunction with the description of the operation of the padding press 10 of the present invention.

Still referring principally to FIGS. 1, 3 and 4, the support board assembly 14 is disclosed in detail. The support board assembly 14 includes a main support board 52, two side rails 54 and an end rail 56. The entire support board assembly 14 is dimensioned to slideably fit on the top of the base 12, as is shown on FIGS. 1 and 3.

The end rail 56 of the support board assembly 14 acts as a catch to limit the inward sliding movement of the support board assembly 14 towards the adjusting board 16.

The clamping board assembly 18 of the padding press 10 of the present invention is best disclosed on FIGS. 1, 4 and 5. In the herein described preferred embodiment the clamping board assembly 18 is a substantially T-shaped assembly of individual board pieces, which includes a base board 58 and an upright board 60.

Figure 2:
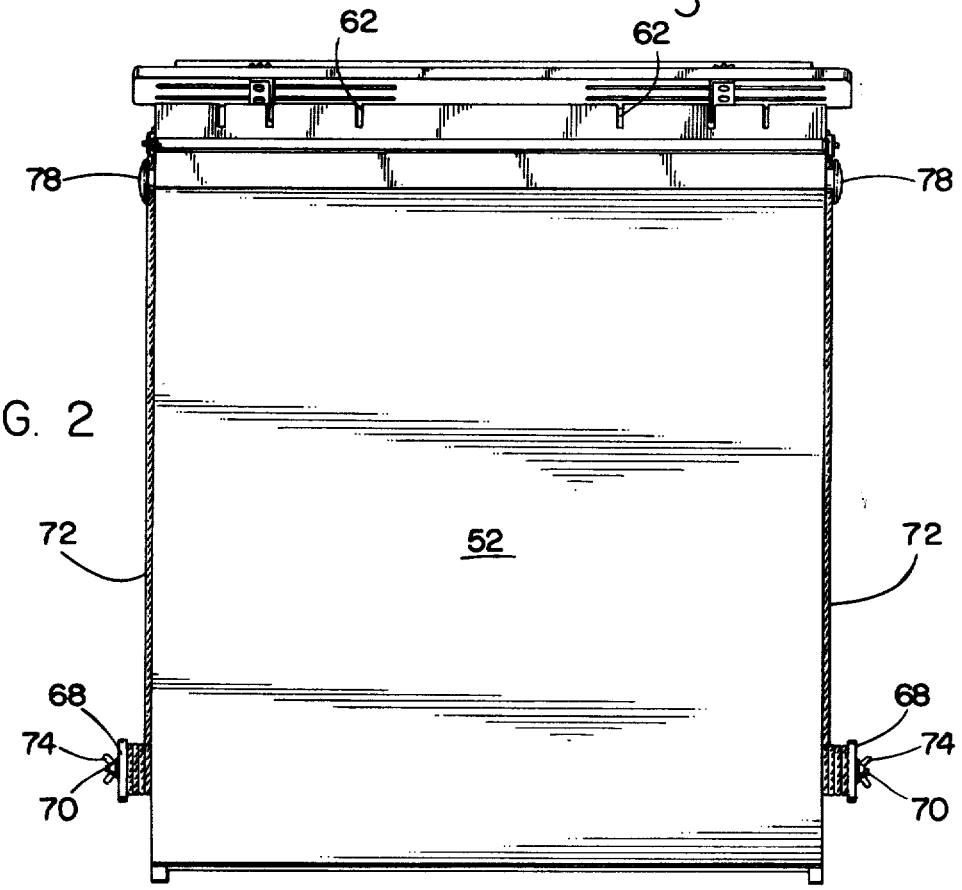
FIG. 2 is top view of the improved padding press of the present invention.

A side of the base board 60 which, in the operating padding press 10 is disposed adjacent to the adjusting board 16, is provided with a plurality of notches 62. The purpose of the notches 62 is to accommodate several predetermined positions of the guide rails 46. They are shown on the top view of FIG. 2. The notches 62 are spaced to accomodate the guide rails 46 in the several often used positions of the guide rails 46 which correspond to the most often used paper sizes padded on the padding press 10 of the present invention. It should be emphasized, however, that in other embodiments (not shown), the clamping board assembly 18 may be readily adapted to accomodate continuously changing positions of the guide rails 46.

Referring now principally to FIGS. 1, 4 and 5, a clamping assembly 64, which is designed to permit application of a clamping force upon a stack of paper 66, shown on FIGS. 1 and 3, with only a small effort by an operator (not shown), is disclosed.

The clamping assembly 64 includes a pair of spindles 68, with one spindle 68 being rotatably attached to a threaded bolt 70 on each side rail 54 of the support board assembly 14. A cord 72 is attached to each spindle 68 so that the cord 72 may be wound up on the spindle 68. A wing nut 74 is secured to the threaded bolt 70 of each spindle 68. Thus, when desired, an operator (not shown) may tighten the wing nut 74 to prevent rotation of the spindle 68 and unwinding of the cord 72.

An end of each cord 72 remote from the spindle 68, terminates in a hook 76. When it is desired to clamp the stack of paper 66 between the clamping board assembly 18 and the support board assembly 14, each cord 72 is looped around a knob 78 projecting outwardly from the side rail 54 of the support board assembly 14.

Each end of the clamping board assembly 18 bears a pivotable latching and fastening device 80 similar to the type often used for closure of chests, suit cases and the like. The latching and fastening device 80, best shown on FIG. 5, includes a clamp 82 which is pivotably attached through a pivot pin 84 to a stationary member 86. The stationary member 86, in turn, is fastened by screws 88 to the clamping board assembly 18. A bracket 90 is pivotably attached to the clamp 82. A slotted plate or member 92 is unitarily constructed with the clamp 82 and is adapted to engage an outwardly projecting stationary locking plate or member 94. The hooks 76 at the ends of the cords 70 are secured to the respective brackets 90.

In order to apply a clamping force to the stack of paper 66, the clamp 82, together with the slotted plate 92 and the bracket 90, is pivoted upward by an operator (not shown) pulling the cords 72 in the same direction. Thereafter, the slotted plate 92 engages the stationary locking plate 94 and a force vector acting on the cords 72 and the latching device 80 substantially crosses the pivot pin 84. As a result, the latching device 80 is locked into position until it is released by an operator (not shown).

Referring now principally to FIGS. 1 and 3, the blower 32 is disclosed. The blower 32 is mounted within the interior of the box shaped base 12, and is adapted for blowing heated air substantially in an upwardly direction. The blower 32 may be a commercially available, electrically operated hair dryer or like device. It includes an electric fan (not shown) and heating coils (not shown) to heat the incoming air. In the herein disclosed preferred embodiment, the blower 32 includes a timer 96 whereby an operator (not shown) may select the desired time of operation of the blower 32. As is shown in FIG. 3, when the blower 32 is operated, the support board assembly 14, having the stack of paper 66 clamped thereto, is slid backwards on the base 12. This is for the purpose of exposing the glued edge of the stack 66 to the outcoming heated air.

The entire operation of the hereinbefore-described padding press 10 should be readily apparent to one skilled in the art from the above description taken together with the drawing Figures. For the purpose of complete disclosure, however, the operation is briefly described below.

First, the guide rails 46 of the adjusting board 16 are adjusted to receive edges of the identically sized sheets of paper to be padded in the padding press 10. The support board assembly 14 is placed on top of the base 12, and is slid towards the adjusting board 16 as far as it will go. Sheets of paper comprising the stack 66 are then placed on top of the main support board 52 between the guide rails 46 and abutting the adjusting board 16.

Thereafter, the clamping board assembly 18 is placed on top of the stack 66, the cords 72 are looped around the knobs 78 and the hooks 76 are secured to the pivotable brackets 90. The cords 72 are wound up on the spindles 68 until a desired tension of the cords 72 is reached and the wing nuts 74 of the spindles 68 are tightened. The clamps 84 of the latching device 82 are then pivoted and locked into position. It is noteworthy that the last described step requires only a relatively small exertion of force by an operator although the resultant clamping force bearing down on the stack of paper 66 is considerable.

For the subsequent gluing step, the support board assembly 14 is slid away from the adjusting board 16 and the adjusting board 16 is preferably removed from the base 12. Glue or a like adhesive substance is applied to the exposed edge of the clamped stack 66. Thereafter, the blower 32 is activated for a desired length of time to accelerate drying and bonding of the glue. The clamping board assembly 14 is then removed from the top of the stack 66 and the glued stack 66 is removed from the padding press.

What has been described above is a padding press 10 adapted for performing the process of padding paper in a convenient and fast manner. The padding press of the present invention is particularly useful in the quick printing industry where speed of the padding process is particularly important. In this regard, it is noted that on the padding press of the present invention a padding operation may be completed in approximately three minutes. On the padding presses of the prior art the same padding operation is usually completed in approximately thirty minutes.

Several modifications of the padding press 10 of the present invention may become apparent to those skilled in the art in light of the above disclosure. Therefore, the scope of the present invention should be limited only by the following claims.

What is claimed is:

1. An apparatus for padding paper comprising:

a base member including a top surface;

a support board assembly slideable upon the top surface of the base member, the support board assembly including a main support board and a catch member which is adapted to limit the sliding motion of the support board assembly on the base member so as to cause the support board assembly to occupy at least one predetermined position on the base member;

an adjusting board removably attachable to the base member in a position wherein the adjusting board is substantially orthogonal to the main support board;

a clamping board adapted for exerting a downwardly projecting clamping force upon a stack of paper positioned between the main support board and the clamping board;

clamping means attached to the clamping board and the support board assembly for applying the clamping force upon the clamping board;

adjusting means including a pair of parallel disposed adjusting rails, for continuously adjusting a gap adapted to align the stack of paper in operative position on the main support board, the adjusting means being attached to the adjusting board, and blower means incorporated in the base member and actuable at the option of an operator for blowing air upon a glued edge of the stack of paper clamped between the main support board and the clamping board.

2. The invention of claim 1 wherein the blower means are adapted for blowing heated air.

3. The invention of claim 1 wherein the top surface of the base member is slightly inclined relative to the horizontal direction and slopes downwardly toward the adjusting board.

4. The invention of claim 1 wherein the adjusting means include a plurality of notches cut in the adjusting board substantially at a right angle relative to the adjusting rails and wherein the adjusting means further include a plurality of releasable fasteners fastening the adjusting rails through the notches to the adjusting board.

5. The invention of claim 1 wherein the clamping means include a pair of cords, each cord being connected at a first end thereof to the main support assembly, a second end of each cord being removably connectable to the clamping board, means for adjusting the tension of each cord to a predetermined desired tension, and means for pivotably and releasably increasing the tension of each cord so as to apply the clamping force to the clamping board.

6. The invention of claim 5 wherein the means for adjusting the tension of each cord comprise a spindle associated with each cord and rotatably attached to the main support board assembly, the cord capable of being wound up on the spindle, and a nut holding each spindle upon a threaded bolt and capable of being tightened so as to prevent rotation of the spindle.

7. The invention of claim 6 wherein the means for pivotably and releasably increasing the tension of each cord comprise a clamp associated with each cord and pivotably attached to the clamping board through a pivot hinge, a bracket pivotably attached to each clamp and engaging a hook attached to the second end of each cord, a stationary locking member associated with each clamp and fixedly attached to the clamping board, and a slotted locking member attached to each clamp and adapted for receiving the stationary locking member when the clamp, bracket and slotted locking member is pivoted by an operator into an upwardly position, whereby a downward projecting force vector of the tensioned cord substantially crosses the pivot pin so that the clamp, bracket and slotted locking member is locked into position until a further force is applied by an operator to release said clamp, bracket, stationary locking member and the attached tensioned cord.

8. A paper padding apparatus comprising:

a substantially box-shaped base;

a support board assembly including a main support board which substantially comprises a cover for the box-shaped base, a pair of parallel spaced side boards being attached substantially at the respective edges of the support board in an orthogonal relationship thereto, and a cross-piece being attached to the main support board, the support board assembly being slideable on the base until the cross-piece catches the base so as to provide a predetermined positioning of the support board assembly on the base;

an adjusting board removably attachable to the base in a position wherein the adjusting board is substantially orthogonal to the main support board, the adjusting board including a pair of substantially parallel guide rails for aligning a stack of paper on the main support board;

a clamping board attachable to the support board assembly, and clamping means including a pair of cords and a clamping bracket assembly attached respectively to the support board assembly and to the clamping board for preadjusting the tension of the cords and, thereafter, applying a force causing the clamping board to bear down on the stack of paper positioned on the main support board, said force being applied by an operator by manipulating the clamping bracket assembly.

9. The invention of claim 8, wherein each cord of the pair of cords is attached to a respective side board of the support board assembly.

10. The invention of claim 8, wherein the clamping means includes a pair of spindles, each spindle being rotatably attached to the support board assembly and a first end of each cord is attached to a respective spindle, the cord being woundable on the spindle; the clamping means further including locking means for locking the spindle after the predetermined tension of the respective cord is set.

11. The invention of claim 10, wherein each spindle is attached to a respective side board of the support board assembly.

12. The invention of claim 10 further including blower means mounted in the base, the blower means being adapted for blowing air upon an edge of the stack of paper.

13. The invention of claim 12, wherein the blower means further include timer means actuable by an operator for selecting a predetermined amount of time for the operation of the blower means.

14. The invention of claim 8, wherein the adjusting board has a plurality of notches disposed substantially at a right angle to the guide rails, and releasable fastening means for fastening the guide rails through the notches to the adjusting board.

15. The invention of claim 8, wherein the base includes an end board and a cross-board substantially parallel disposed with the end board, a gap between the end-board and the cross-board being adapted for receiving the adjusting board in a substantially upright position relative to the base.

16. The invention of claim 8 further including blower and heater means for blowing heated air upon an edge of the stack of paper clamped between the support board assembly and the clamping board, the blower and heater means being mounted in the base.

17. The invention of claim 16, wherein the blower and heater means further comprise timer means actuable by an operator for selecting a predetermined amount of time for the operation of the blower and heater means.

18. An apparatus for padding paper comprising:

a base member including a top surface;

an adjusting board attached to the base;

blower means mounted in the base for blowing heated air in a generally upwardly direction from the base;

a support board assembly slideably mounted in the base;

clamping means including a clamping board for clamping a stack of paper between the support board assembly and the base, the support board assembly being adapted to occupy one fixed position relative to the base wherein the stack of paper is aligned with one edge abutting the adjusting board, and at least one other position wherein the heated air blown by the blower means is blown substantially upon an exposed glued edge of the stack of paper for drying said exposed glued edge.

19. The invention of claim 18, wherein the blower means include timer means actuable by an operator for selecting a desired time period for operation of the blower means.

20. The invention of claim 18, wherein the clamping means include a pair of cords attached to the support board assembly, clamping bracket means attached to the clamping board for applying a force causing the clamping board to bear down upon the stack of paper between the clamping board and the support board assembly and for locking the clamping board in said position wherein it bears down upon the stack of paper and spindle means attached to each cord and to the support board assembly for adjusting the tension of each cord prior to application of said force through the clamping bracket means.

* * * * *